US011043750B2

(12) United States Patent
Sezai

(10) Patent No.: US 11,043,750 B2
(45) Date of Patent: Jun. 22, 2021

(54) ANTENNA

(71) Applicant: JAPAN AEROSPACE EXPLORATION AGENCY, Tokyo (JP)

(72) Inventor: Toshihiro Sezai, Tokyo (JP)

(73) Assignee: JAPAN AEROSPACE EXPLORATION AGENCY, Tokyo (JP)

( * ) Notice: Subject to any disclaimer, the term of this patent is extended or adjusted under 35 U.S.C. 154(b) by 0 days.

(21) Appl. No.: 16/728,537

(22) Filed: Dec. 27, 2019

(65) Prior Publication Data

US 2020/0266546 A1 Aug. 20, 2020

(30) Foreign Application Priority Data

Jan. 18, 2019 (JP) ..... JP2019-007103

(51) Int. Cl.
*H01Q 15/16* (2006.01)
*H01Q 19/13* (2006.01)
*H01Q 15/14* (2006.01)

(52) U.S. Cl.
CPC ..... *H01Q 15/16* (2013.01); *H01Q 15/142* (2013.01); *H01Q 19/13* (2013.01)

(58) Field of Classification Search
CPC ..... H01Q 15/16; H01Q 19/13; H01Q 19/19; H01Q 19/12; H01Q 15/14; H01Q 1/28
See application file for complete search history.

(56) References Cited

U.S. PATENT DOCUMENTS 3,363,252 A * 1/1968 Hacker ..... H01Q 19/134 343/756
6,020,859 A * 2/2000 Kildal ..... H01Q 1/42 343/781 CA
8,717,250 B2 * 5/2014 Nilsson ..... H01Q 19/17 343/893
9,941,570 B2 * 4/2018 Sanford ..... H01Q 1/421
2020/0052410 A1 * 2/2020 Tanabe ..... H01Q 1/1257

FOREIGN PATENT DOCUMENTS

JP S50-099451 A 8/1975
JP 2003-060426 A 2/2003
JP 2003-273642 A 9/2003

OTHER PUBLICATIONS

Office Action dated Oct. 2, 2019 in Japanese Application No. 2019-007103, along with its English translation.
Office Action dated Apr. 21, 2020 in French Application No. 2000436, along with its English translation.

* cited by examiner

*Primary Examiner* — Vibol Tan
(74) *Attorney, Agent, or Firm* — Saliwanchik, Lloyd & Eisenschenk

(57) ABSTRACT

Provided is an antenna including: a primary radiator configured to radiate radio waves; and a parabolic reflector configured to reflect the radio waves radiated by the primary radiator and has an aperture diameter reduced to be equal to or smaller than an aperture diameter with which no null points are generated in an antenna pattern in a semi-sphere where the radio waves are reflected and radiated.

5 Claims, 8 Drawing Sheets

ANTENNA

CROSS-REFERENCE TO RELATED APPLICATION

This application claims the benefit of Japanese Priority Patent Application No. 2019-007103, filed Jan. 18, 2019, the entire contents of which are incorporated herein by reference.

BACKGROUND

The present invention relates to an antenna.

For an antenna to be mounted on a flying object such as a rocket and an aircraft, it is required to radio waves uniformly radiated in a wide area and to withstand aerodynamic loading and aerodynamic heating that occur in flight. In the current state, a blade antenna, a monopole antenna, or a patch antenna is mainly used as an antenna to be mounted on a rocket or the like (see Japanese Patent Application Laid-open No. 2003-60426).

SUMMARY

However, those antennas have the following circumstances.

- An antenna beam has null points (hollow). In the case of the blade antenna and the monopole antenna, the antenna patterns of linear polarization and circular polarization have null points. In the case of the patch antenna, the antenna pattern of circular polarization has null points.
- The patch antenna is incapable of radiating radio waves in a wide area because the linear polarization of the patch antenna is not radiated in a direction of the mounting surface of the antenna.
- The body of the flying object functions as an antenna element because the blade antenna, the monopole antenna, and the patch antenna are all unbalanced-type antennas. The antenna pattern can be thus affected by the shape of the body and an antenna-mounting portion, and the antenna pattern can significantly differ from the pattern of the antenna itself.
- The blade antenna, the monopole antenna, and the patch antenna have a portion(s) projected from the surface of the body of the flying object. It is thus necessary to provide a rigid structure to withhold aerodynamic loading and heating or an additional structure to protect the antenna. In this case, the antenna pattern can be affected by those structures and the antenna pattern can significantly differ from the pattern of the antenna itself
- A flying object such as a rocket is imposed operational restrictions of changing vehicle attitude in flight and flight path due to the pattern characteristics of an antenna mounted on the flying object.

In view of the above-mentioned circumstances, one or more aspects of the present invention are directed to provide a high-gain antenna having uniformly stable pattern characteristics in a wide area.

One or more aspects of the present invention are also directed to provide an antenna which eliminates operational restrictions of a flying object due to the antenna pattern characteristics, in the case where the antenna is mounted on the flying object.

One or more aspects of the present invention are also directed to sufficiently alleviate aerodynamic loading and heating that occur on the antenna, in the case where the antenna is mounted on the flying object.

The antenna according to the present invention employs a parabolic antenna form. Parabolic antennas are widely used for applications including an antenna for receiving satellite broadcasting, a ground fixed communication antenna, a ground-station antenna for space communications, a radio astronomy antenna, and the like. It is because an antenna pattern having high antenna gain and sharp directivity can be provided by setting the aperture diameter of the parabolic antenna to be larger than the wavelength. The dimension of a parabolic reflector for the use in the antenna for receiving satellite broadcasting is typically 17 times or more as large as the wavelength, for example. The parabolic antenna is typically used with the aperture diameter set to be larger than the wavelength.

The antenna according to the present invention employs the parabolic antenna form. Note that for using the antenna according to the present invention, the aperture diameter of the antenna according to the present invention is reduced to be equal to or smaller than an aperture diameter with which no null points are generated in an antenna pattern in a semi-sphere where radio waves are radiated in contrast to typical usage of the parabolic antenna.

That is, an antenna according to an aspect of the present invention includes: a primary radiator configured to radiate radio waves; and a parabolic reflector configured to reflect the radio waves radiated by the primary radiator and has an aperture diameter reduced to be equal to or smaller than an aperture diameter with which no null points are generated in an antenna pattern in a semi-sphere where the radio waves are reflected and radiated.

Any type of antenna element can be employed as the primary radiator. The primary radiator is favorably disposed in a region inside an aperture plane of the parabolic reflector, specifically, on the aperture plane or inside the aperture plane.

The region inside the aperture plane may be filled with a dielectric material. It should be noted that the dielectric material may have a cavity portion. Moreover, the primary radiator may be disposed in the dielectric material.

The antenna according to the aspect of the present invention has the following characteristics.

- The antenna beam becomes wide and radio waves are radiated in a wide area. The radio waves are also radiated downward from the antenna-mounting surface.
- No null points and hollow are generated in a semi-sphere above the antenna-mounting surface.
- No side lobes are generated in a semi-sphere above the antenna-mounting surface.

In addition, the antenna according to the aspect of the present invention has the following characteristics.

- As it is a reflector antenna, the antenna pattern is hardly affected by the shape of the mounting object on which the antenna is mounted and an antenna-mounting portion.
- The antenna can be mounted without projecting from the surface of the mounting object by forming a hole having the same shape and dimension as the parabolic reflector in a surface of the mounting object or inside the mounting object. With this configuration, aerodynamic loading and heating on a flying object such as a rocket and an aircraft are sufficiently alleviated, for example. Owing to the small aperture diameter of the antenna according to the present invention, influence of forming the hole on the flying object is ignorably small.

Moreover, in the case where the antenna according to the aspect of the present invention is mounted inside or outside an electronic apparatus having a wireless communication function, such as a personal computer (PC), or a building, the antenna can be mounted without projecting from the surface by forming a hole having the same shape and dimension as the parabolic reflector in a substrate of electronic components, an outer wall, interior wall, ceiling surface of the building, or inside the mounting object, for example. In addition, the footprint can also be reduced due to the reduced aperture diameter. The thickness and weight can be thus reduced in comparison with stick antennas and the like in the related art. Higher antenna gain can be obtained because the parabolic antenna is used as a basic configuration. The antenna can be made unremarkable by using the same color and patterns for a front surface of the antenna as the wall or ceiling of the building.

In accordance with the antenna according to the present invention, the antenna has the characteristics of uniformly stable pattern in a wide area, and the gain is increased in comparison with an antenna mounted on a flying object in the current state.

Moreover, in the case where the antenna according to the present invention is mounted on a flying object, the flying object mounts the antenna is not imposed on operational restrictions due to the pattern characteristics of the antenna.

Moreover, in the case where the antenna according to the aspect of the present invention is mounted on a flying object, aerodynamic loading and heating that occur on the antenna are sufficiently alleviated.

Furthermore, the antenna according to the aspect of the present invention is reduced in thickness and weight and becomes unremarkable in comparison with antennas in the related art.

DETAILED DESCRIPTION OF EMBODIMENTS

Hereinafter, embodiments of the present invention will be described with reference to the drawings.

Figure 1:
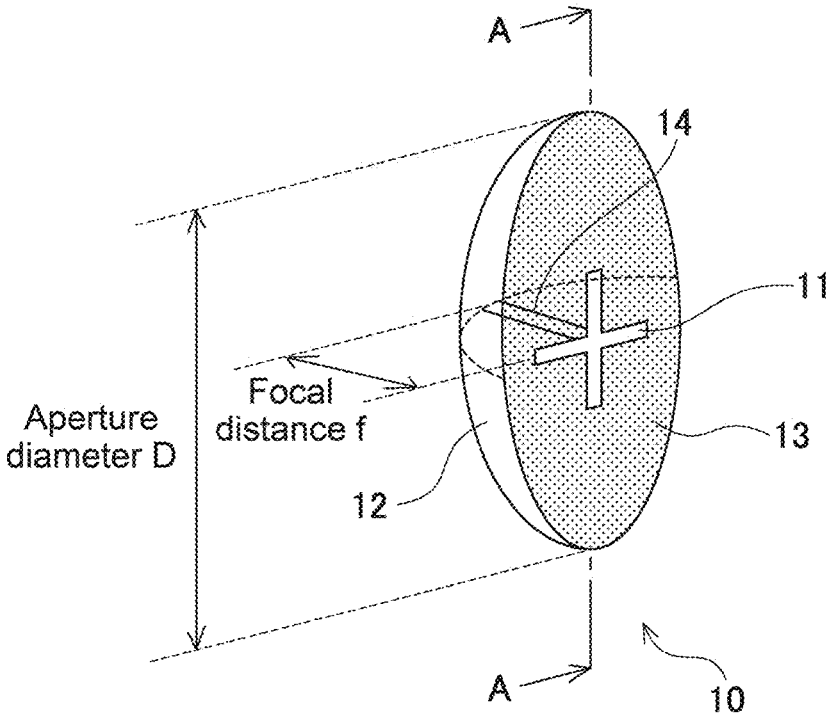
FIG. 1 is a perspective view showing a configuration of an antenna according to an embodiment of the present invention.
Figure 2:
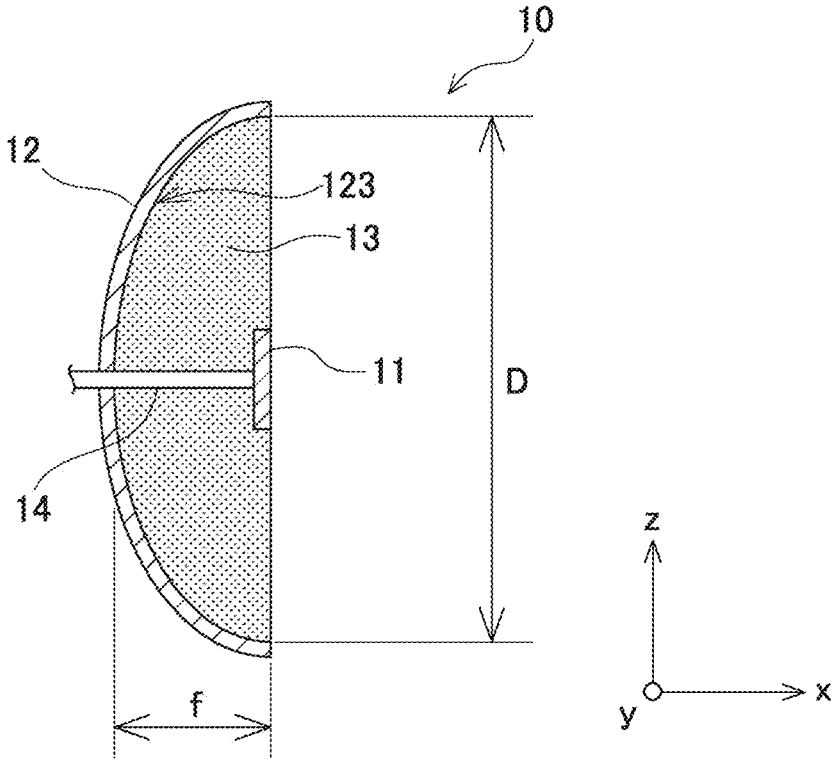
FIG. 2 is a cross-sectional view taken along the line A-A of FIG. 1.

FIG. 1 is a perspective view showing a configuration of an antenna according to an embodiment of the present invention. FIG. 2 is a cross-sectional view taken along the line A-A of FIG. 1.

As shown in FIGS. 1 and 2, an antenna 10 includes a primary radiator 11 and a parabolic reflector 12. The parabolic reflector 12 is filled with a dielectric material 13. A feed cable 14 is connected to the primary radiator 11.

The primary radiator 11 is an antenna element configured to radiate radio waves. Any antenna element can be used as the primary radiator 11 as long as the antenna element has a predetermined impedance. An example using a cross-dipole antenna is shown in this embodiment. Alternatively, a dipole antenna, a horn antenna, or the like may be used.

The parabolic reflector 12 is formed like a paraboloid of revolution made of an electrically conductive material, having a diameter D of the aperture (aperture diameter) and a focal distance f. The primary radiator 11 is positioned at a focal point of the parabolic reflector 12. Moreover, the parabolic reflector 12 has an aperture diameter D reduced to be equal to or smaller than an aperture diameter with which no null points are generated in an antenna pattern of a semi-sphere where the radio waves radiated by the primary radiator 11 are reflected by the parabolic reflector 12. In this case, the aperture diameter D and the dimension of the primary radiator 11 can be reduced within a range enabling the antenna to function. The range enabling the antenna to function means a range enabling the primary radiator 11 to obtain a predetermined impedance. In other words, the range enabling the antenna to function means a range in which the voltage standing wave ratio (VSWR) of the primary radiator 11 is equal to or smaller than a value intended by a system using the antenna. Since no null points are generated by the antenna 10 according to this embodiment, side lobes are also not generated as a matter of course. That is, the antenna 10 according to this embodiment is capable of uniformly radiating radio waves in the semi-sphere where radio waves are radiated.

The dielectric material 13 is filled in a region from an aperture plane of the parabolic reflector 12 to an inner surface 123 of the parabolic reflector 12. The primary radiator 11 is disposed in the dielectric material 13. For example, the primary radiator 11 is disposed at the position of the aperture plane or at a position inside that position. The feed cable 14 is a cable for feeding power to the primary radiator 11. FIGS. 1 to 2 show an example in which the feed cable 14 is wired from a lowermost surface of the parabolic reflector 12 to the primary radiator 11. Alternatively, how to wire the feed cable 14 is not limited as long as it is wired inside the aperture plane of the parabolic reflector 12.

With this configuration, the dielectric material 13 has a function of retaining the primary radiator 11 and the feed cable 14 at predetermined positions. The dielectric material 13 also has a function of protecting the primary radiator 11 and the feed cable 14 from aerodynamic loading and aerodynamic heating that occur in flight of a rocket or the like and achieves a further reduction in size of the antenna 10 owing to the wavelength shortening effect of the dielectric material. It should be noted that the dielectric material 13 may have a cavity portion (not shown). With this configuration, a reduction in weight of the antenna 10 is achieved.

Figure 3:
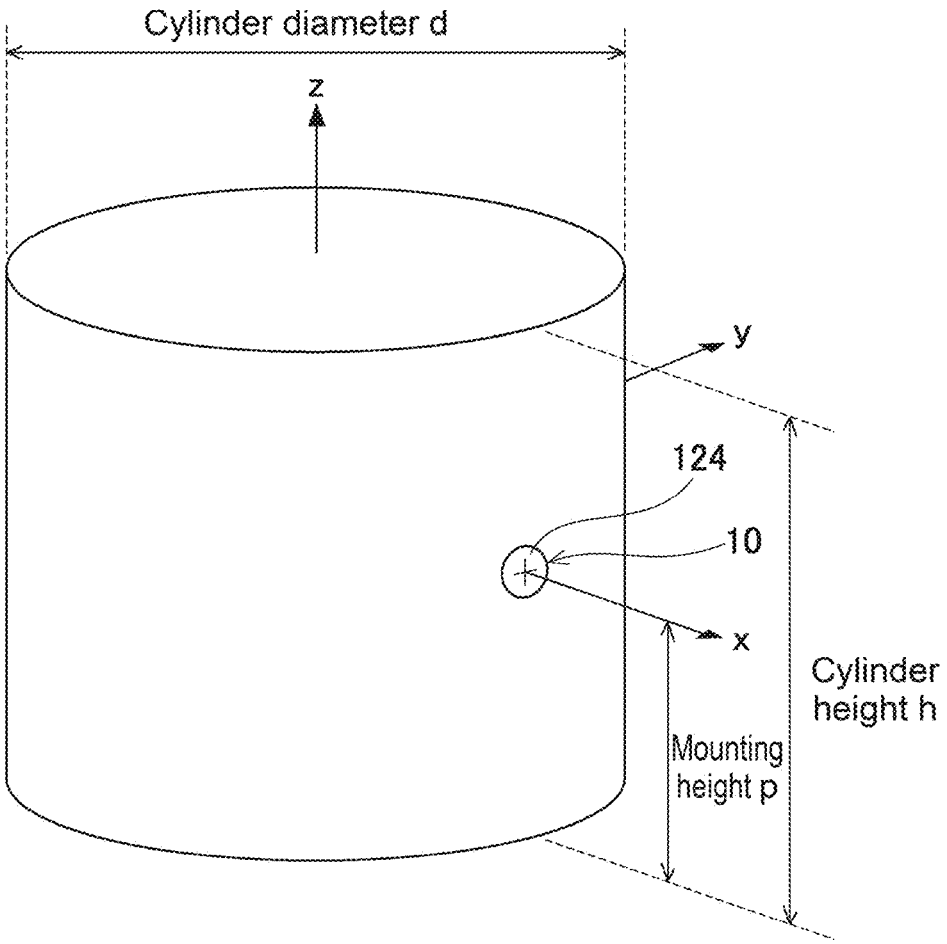
FIG. 3 is a schematic perspective view of a dummy rocket body on which the antenna according to the embodiment is mounted.

FIG. 3 shows a dummy rocket body used for analyzing an antenna pattern of the antenna 10 according to this embodiment in the case where the antenna 10 is mounted on a flying object.

The dummy rocket body was a metal cylinder having a diameter d and a height h. The antenna 10 according to this embodiment was mounted at the center of the cylindrical surface.

Figure 4:
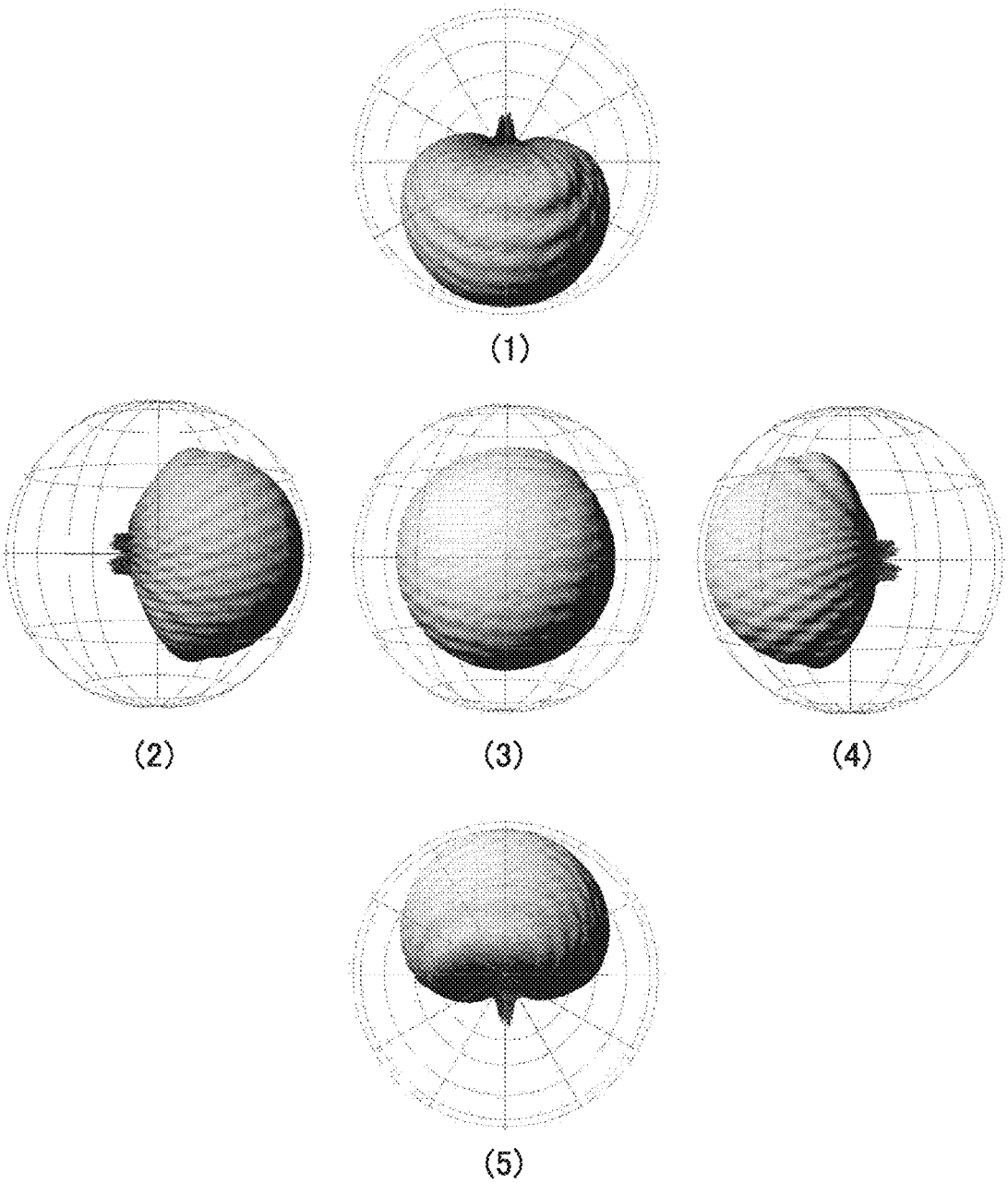
FIG. 4 depicts an antenna pattern (right-handed polarization) obtained by the analysis as three dimensional whole spherical models, in the case where the antenna according to the present invention shown in FIG. 3 is mounted on the dummy rocket body.

An analysis result in this case is shown in FIG. 4.

Here, the antenna 10 was set to have a frequency of 2.3 GHz. The primary radiator 11 and the parabolic reflector 12 were made of copper. The parabolic reflector 12 was filled with Teflon (registered trademark) as the dielectric material 13. The antenna 10 was set to have D=88 mm and f=21 mm. Moreover, in FIG. 3, the dummy rocket body was made of copper. The dummy rocket body was set to have d=2500 mm and h=2000 mm. A hole 124 having the same shape and dimension as the parabolic reflector was formed at a position p=1000 mm of the dummy rocket body. The antenna 10 was mounted inside the dummy rocket body. FIG. 4 shows an antenna pattern of right-handed polarization obtained by the analysis.

The figure depicts as three dimensional whole spherical models in which the antenna absolute gain is −30 dBi to 10 dBi, using gray scale gradation and radial lengths.

Figure 5:
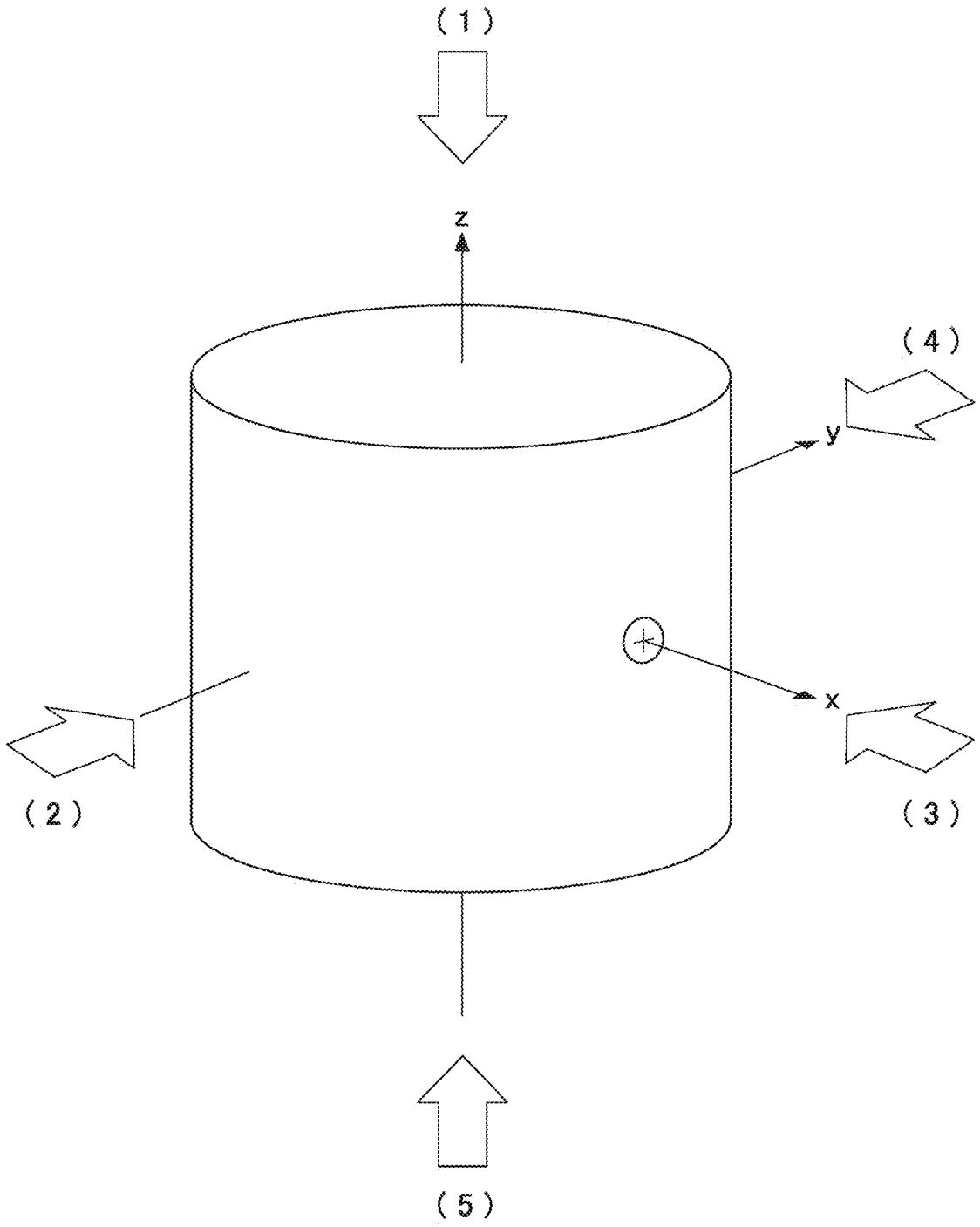
FIG. 5 is a diagram showing line-of-sight directions indicated as (1) to (5) of FIG. 4 and FIGS. 6 to 8.

In FIG. 4, (1) is a representation as viewed from +z direction (lower: +x direction, right: +y direction), (2) is a representation as viewed from −y direction (right: +x direction, upper: +z direction), (3) is a representation as viewed from +x direction (right: +y direction, upper: +z direction), (4) is a representation as viewed from +y direction (left: +x direction, upper: +z direction), and (5) is a representation as viewed from −z direction (upper: +x direction, right: +y direction) (see FIG. 5).

It should be noted that the wavelength is approximately 130 mm, D is approximately 0.67 wavelength, and f is approximately 0.16 wavelength. As can be seen from FIG. 4, the antenna pattern in the state in which the antenna which is the antenna 10 according to this embodiment is mounted on the dummy rocket body is substantially isotropic in the semi-sphere of +x direction on which the antenna 10 is mounted. Moreover, as can also be seen from FIG. 4, there are no null points and side lobes in the antenna pattern and radiation is performed downwards (−x direction) from the mounting surface of the antenna 10.

Figure 6:
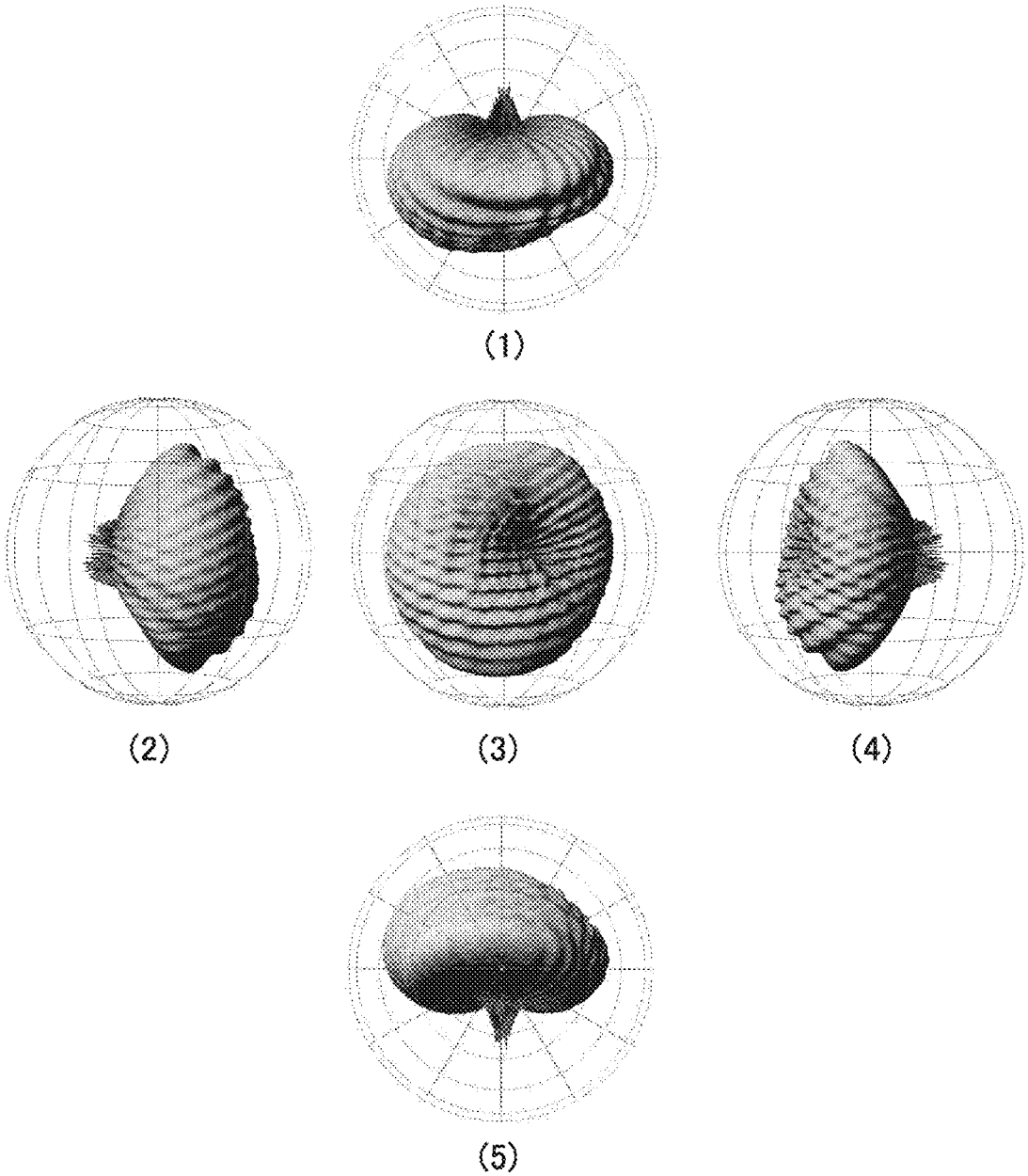
FIG. 6 depicts an antenna pattern (right-handed polarization) obtained by the analysis as three dimensional whole spherical models, in the case where a blade antenna is mounted on the dummy rocket body as a comparative example.
Figure 7:
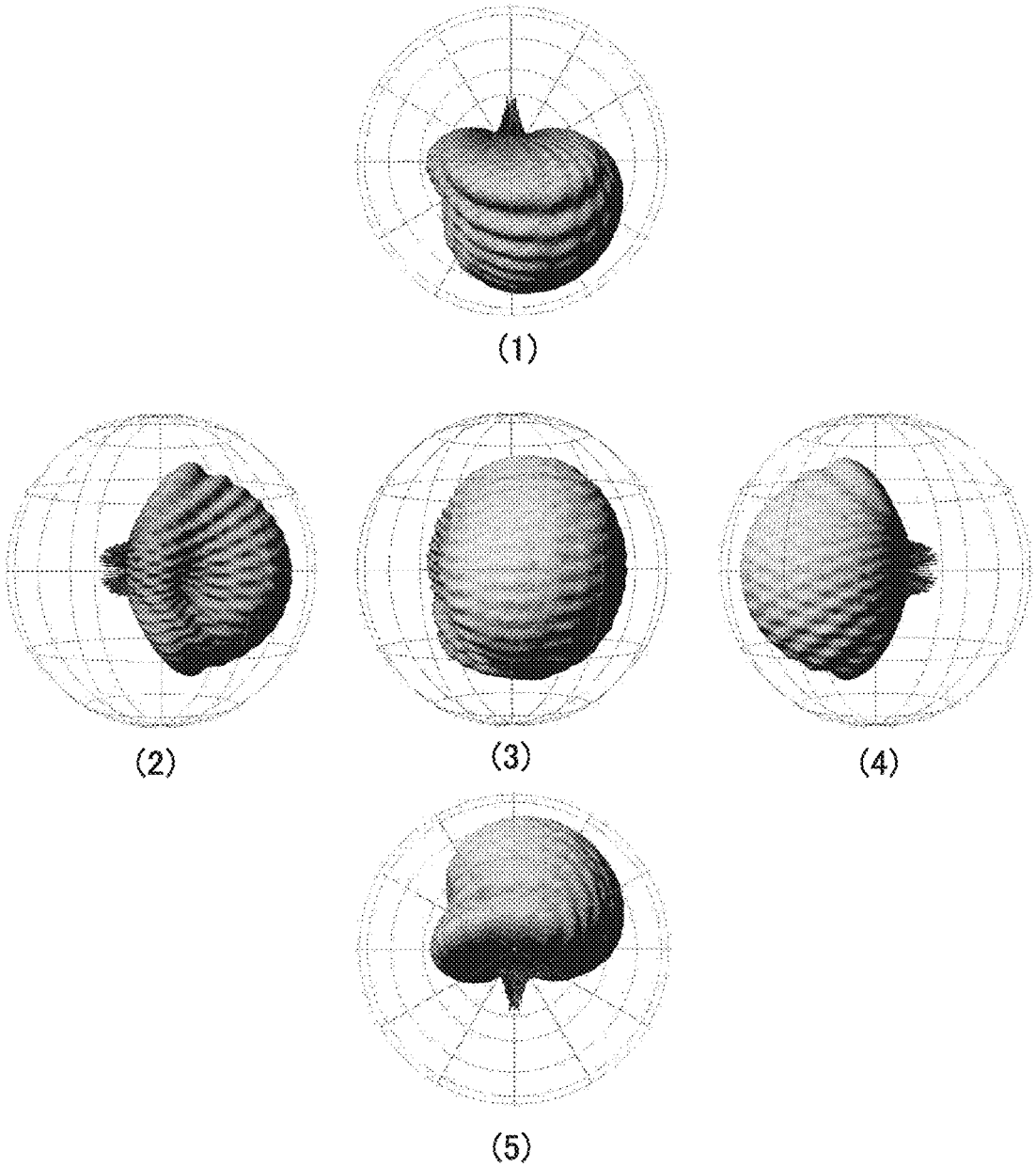
FIG. 7 depicts an antenna pattern (right-handed polarization) obtained by the analysis as three dimensional whole spherical models, in the case where a patch antenna is mounted on the dummy rocket body as a comparative example.
Figure 8:
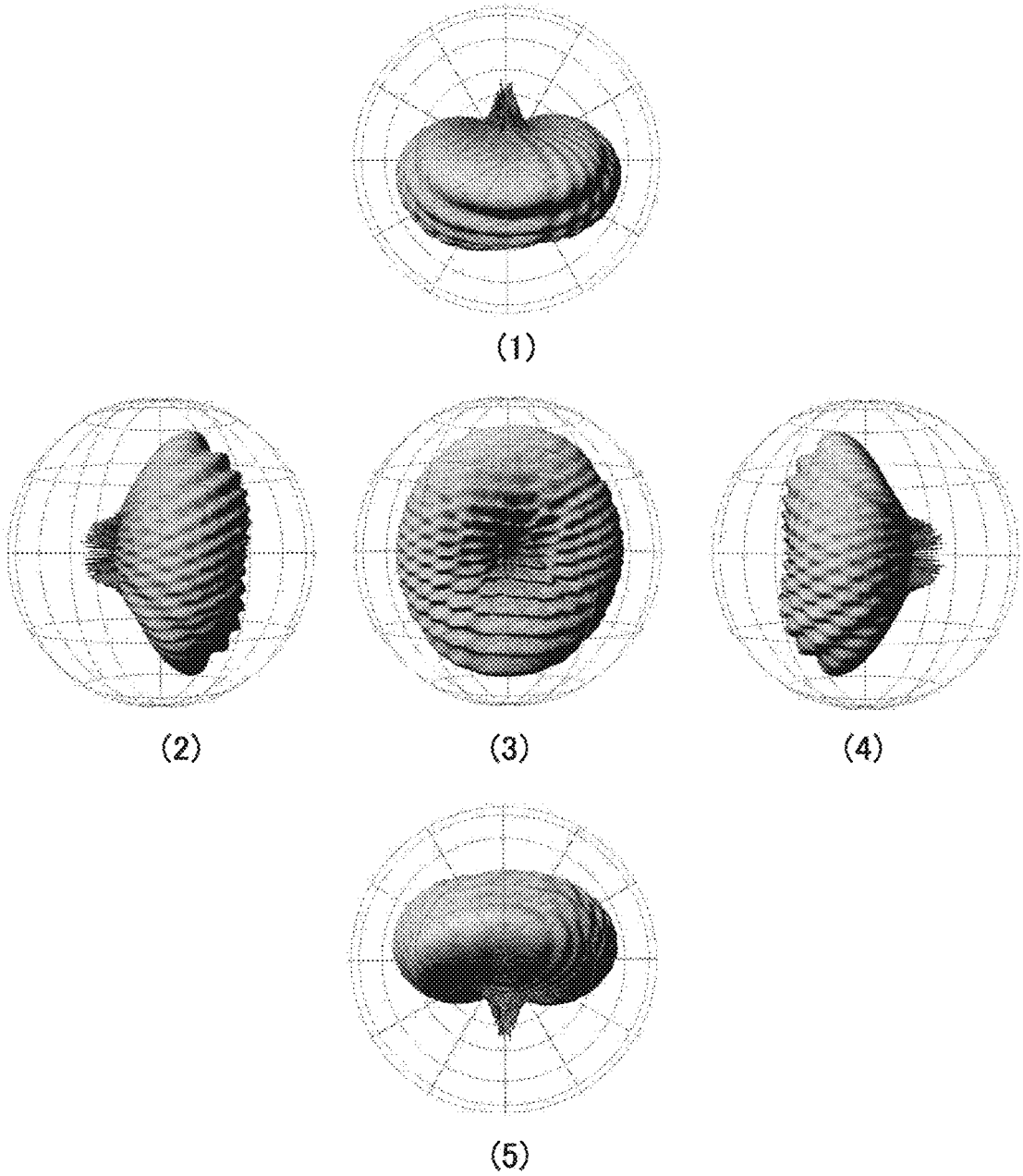
FIG. 8 depicts an antenna pattern (right-handed polarization) obtained by the analysis as three dimensional whole spherical models, in the case where a monopole antenna is mounted on the dummy rocket body as a comparative example.

FIGS. 6 to 8 show comparative examples.

FIG. 6 depicts an antenna pattern (right-handed polarization) obtained by analysis as three dimensional whole spherical models in the state in which a blade antenna is mounted on the dummy rocket body. FIG. 7 depicts an antenna pattern (right-handed polarization) obtained by analysis as three dimensional whole spherical models in the state in which a patch antenna is mounted on the dummy rocket body. FIG. 8 depicts an antenna pattern (right-handed polarization) obtained by analysis as three dimensional whole spherical models in the state in which a monopole antenna is mounted on the dummy rocket body. The depiction way and the antenna absolute gain range of FIGS. 6 to 8 are similar to those of FIG. 4.

Comparing the antenna patterns according to the comparative examples of FIGS. 6 to 8 with the antenna pattern according to this embodiment shown in FIG. 4, the antenna pattern of the antenna 10 according to this embodiment is more isotropic in the semi-sphere of +x direction on which the antenna 10 is mounted in comparison with the antenna patterns according to the comparative examples.

As described above, it can be seen that the antenna 10 according to this embodiment has an ideal antenna pattern for the antenna to be mounted on a flying object.

In the antenna 10 according to this embodiment, the aperture diameter D of the parabolic reflector 12 is set to be equal to or smaller than an aperture diameter with which no null points are generated in the antenna pattern in the semi-sphere where reflected radio waves are radiated. The inventor of the present invention analyzed the antenna itself by varying the aperture diameter D. The antenna itself refers to the antenna 10 according to this embodiment disposed in a free space and does not refer to the antenna 10 embedded in the dummy rocket body as shown in FIG. 4.

Those results confirmed that in the case where the parabolic reflector 12 is filled with Teflon (registered trademark) as the dielectric material 13, no hollows are generated in the antenna pattern in the semi-sphere on which the antenna 10 is mounted as long as the aperture diameter D is equal to or smaller than approximately 1.23 wavelength.

Moreover, those results also confirmed that in the case where the parabolic reflector 12 is not filled with the dielectric material, no hollows are generated in the antenna pattern in the semi-sphere on which the antenna 10 is mounted as long as the aperture diameter D is equal to or smaller than approximately 1.7 wavelength.

From those results, the inventor of the present invention can conclude that the aperture diameter only needs to be set to be equal to or smaller than approximately 1.7 wavelength in the present invention.

The present invention can be applied to a movable object such as an aircraft, a train, an automobile, and an underwater craft, an electronic apparatus such as a portable terminal and a personal computer (PC), and a building as well as the rocket.

Figure 9:
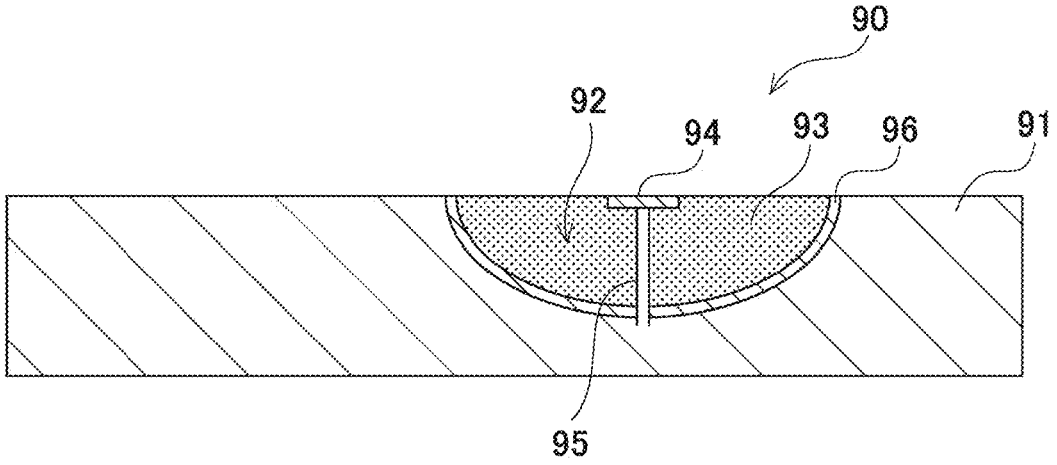
FIG. 9 is a cross-sectional view of a substrate mounted on an electronic apparatus according to another embodiment of the present invention.

FIG. 9 is a cross-sectional view of a substrate to be mounted on an electronic apparatus according to another embodiment of the present invention.

As shown in FIG. 9, a hole 92 having a paraboloid-of-revolution shape is formed in a substrate 91. An electrically conductive thin film 96 is formed on a surface of the hole 92. The hole 92 thus constitutes a reflector portion that functions as the parabolic reflector.

A region inside an aperture plane of the hole 92 is filled with a dielectric material 93.

A primary radiator 94 is typically disposed on the aperture plane of the hole 92 and is retained by the dielectric material 93.

The aperture diameter of the hole 92 is reduced to be equal to or smaller than an aperture diameter with which no null points are generated in an antenna pattern in a semi-sphere where radio waves radiated by the primary radiator 94 are reflected on the above-mentioned reflector. A coaxial cable 95 is retained by the dielectric material 93 and is connected to the primary radiator 94.

In this embodiment, the hole 92 with the electrically conductive thin film 96 with the hole 92 formed thereon, the dielectric material 93, and the primary radiator 94 constitutes an antenna 90.

With an electronic apparatus on which such an antenna 90 is mounted, the antenna 90 can be mounted without projecting from the surface of the substrate 91. In addition, the footprint can also be reduced due to the reduced aperture diameter. The thickness and weight can be thus reduced in comparison with stick antennas and the like in the related art. Higher antenna gain can be obtained because the parabolic antenna is used as a basic configuration.

The present invention is not limited to the above-mentioned embodiments and various modifications and applications can be made without departing from the gist of the technical idea of the present invention, and such modifications and implementations as applications fall within the technical scope of the present invention.

For example, in the case where the antenna according to the present invention is mounted outside or inside a building, the antenna can be made unremarkable by using the same color and patterns for a front surface of the antenna as the wall or ceiling of the building.

What is claimed is:

1. An antenna, comprising:

a primary radiator configured to radiate radio waves; and a parabolic reflector configured to reflect the radio waves radiated by the primary radiator and having an aperture diameter reduced to be equal to or smaller than an aperture diameter with which no null points are generated in an antenna pattern in a semi-sphere where the radio waves are reflected and radiated, wherein the aperture diameter of the parabolic reflector is set to be equal to or smaller than 1.7 times as large as a wavelength of the radio waves radiated by the primary radiator.

2. The antenna according to claim 1, wherein the primary radiator is disposed in a region inside an aperture plane of the parabolic reflector.

3. The antenna according to claim 1, wherein the region inside the aperture plane is filled with a dielectric material.

4. An antenna, comprising:

a primary radiator configured to radiate radio waves; and a parabolic reflector configured to reflect the radio waves radiated by the primary radiator and having an aperture diameter reduced to be equal to or smaller than an aperture diameter with which no null points are generated in an antenna pattern in a semi-sphere where the radio waves are reflected and radiated, wherein the antenna is configured to be embedded in a cavity in a surface of a mounting object on which the antenna is mounted or inside the mounting object.

5. The antenna according to claim 1, wherein the primary radiator is disposed at a position of an aperture plane of the parabolic reflector or inside the position of the aperture plane.

* * * * *